US011801951B2

(12) United States Patent
Pippin et al.

(10) Patent No.: US 11,801,951 B2
(45) Date of Patent: Oct. 31, 2023

(54) SYSTEMS AND METHODS OF AUTO SACKING OF PARCELS

(71) Applicant: Körber Supply Chain LLC, DFW Airport, TX (US)

(72) Inventors: James M. Pippin, Keller, TX (US); Homer L. Dickerson, Fort Worth, TX (US)

(73) Assignee: Körber Supply Chain LLC, DFW Airport, TX (US)

( * ) Notice: Subject to any disclaimer, the term of this patent is extended or adjusted under 35 U.S.C. 154(b) by 131 days.

(21) Appl. No.: 17/460,897

(22) Filed: Aug. 30, 2021

(65) Prior Publication Data

US 2021/0387756 A1 Dec. 16, 2021

Related U.S. Application Data

(63) Continuation of application No. 16/080,686, filed as application No. PCT/US2017/020417 on Mar. 2, 2017, now abandoned.

(Continued)

(51) Int. Cl.

| | |
|---|---|
| ***B65B 5/06*** | (2006.01) |
| ***B07C 3/08*** | (2006.01) |
| ***B65B 35/44*** | (2006.01) |
| ***B65B 39/06*** | (2006.01) |
| ***B65B 43/52*** | (2006.01) |

(Continued)

(52) U.S. Cl.

CPC ..... *B65B 5/067* (2013.01); *B07C 3/08* (2013.01); *B65B 35/44* (2013.01); *B65B 39/06* (2013.01); *B65B 43/52* (2013.01); *B65B 43/54* (2013.01); *B65B 43/60* (2013.01); *B65B 57/00* (2013.01); *B65B 57/14* (2013.01)

(58) Field of Classification Search

CPC ..... B07C 3/08; B65B 5/067

See application file for complete search history.

(56) References Cited

U.S. PATENT DOCUMENTS

| | | | |
|---|---|---|---|
| 2,054,279 | A | 9/1936 | Briggs |
| 2,639,069 | A | 5/1953 | Company |

(Continued)

FOREIGN PATENT DOCUMENTS

| | | | |
|---|---|---|---|
| CN | 87104757 | A | 8/1988 |
| CN | 1198140 | A | 11/1998 |

(Continued)

OTHER PUBLICATIONS

Chen, Gong: "Practical Techniques for Pickled Vegetables Production"; China Light Industry Press, Oct. 31, 2001; ISBN: 7-5019-2975-0; pp. 89-90.

*Primary Examiner* — Jacob S. Scott
*Assistant Examiner* — Miraj T. Patel
(74) *Attorney, Agent, or Firm* — Price Heneveld LLP

(57) ABSTRACT

A parcel sack management system and related process. The parcel sack management system includes a gathering conveyor configured to receive a parcel group at an intake and transport the parcel group to a sack filling station. The system includes a plurality of fill chutes that are transported along a circulating track, each fill chute configured to hold a sack. The parcel sack management system is configured to transfer parcels in the parcel group into a first sack via a first fill chute when the first fill chute is at the sack filling station.

13 Claims, 5 Drawing Sheets

Related U.S. Application Data

(60) Provisional application No. 62/302,537, filed on Mar. 2, 2016.

(51) Int. Cl.

| | |
|---|---|
| ***B65B 43/54*** | (2006.01) |
| ***B65B 43/60*** | (2006.01) |
| ***B65B 57/00*** | (2006.01) |
| ***B65B 57/14*** | (2006.01) |

(56) References Cited

U.S. PATENT DOCUMENTS

| | | | | |
|---|---|---|---|---|
| 2,763,109 | A | 9/1956 | Baker | |
| 3,198,352 | A | 8/1965 | Saunier-Duval | |
| 3,300,066 | A | 1/1967 | Henig et al. | |
| 3,573,748 | A | 4/1971 | Holme | |
| 4,045,940 | A | 9/1977 | White et al. | |
| 4,235,067 | A | 11/1980 | Parsons | |
| 4,509,635 | A | 4/1985 | Emsley et al. | |
| 5,444,962 | A | 8/1995 | Bonnet | |
| 5,544,466 | A | 8/1996 | Bonnet | |
| 6,555,776 | B2 | 4/2003 | Roth et al. | |
| 6,701,697 | B2 | 3/2004 | Savigny et al. | |
| 7,014,030 | B2 | 3/2006 | Hendzel | |
| 7,112,031 | B2 * | 9/2006 | Harres | B07C 3/008 414/281 |
| 7,201,277 | B2 | 4/2007 | Wilke | |
| 7,343,219 | B2 | 3/2008 | Berdelle-Hilge | |
| 7,741,575 | B2 | 6/2010 | Bowers et al. | |
| 7,946,429 | B2 | 5/2011 | Kennedy | |
| 8,086,347 | B2 | 12/2011 | Pandit et al. | |
| 8,230,141 | B2 | 7/2012 | Zimmermann | |
| 8,660,687 | B2 | 2/2014 | Leng | |
| 8,851,269 | B2 | 10/2014 | Hansen | |
| 8,892,240 | B1 | 11/2014 | Vliet et al. | |
| 2004/0073333 | A1 * | 4/2004 | Brill | B07C 3/08 700/224 |
| 2004/0153208 | A1 | 8/2004 | Wilke | |
| 2004/0261366 | A1 | 12/2004 | Gillet et al. | |
| 2005/0216119 | A1 | 9/2005 | Hamilton | |
| 2008/0169346 | A1 | 7/2008 | Schad et al. | |
| 2008/0319574 | A1 | 12/2008 | Wilke | |
| 2014/0116013 | A1 | 5/2014 | Doke | |
| 2015/0209831 | A1 * | 7/2015 | Wargo | B07C 7/00 209/539 |
| 2015/0217334 | A1 * | 8/2015 | Kim | B07C 3/08 209/552 |

FOREIGN PATENT DOCUMENTS

| | | | |
|---|---|---|---|
| CN | 1215015 | A | 4/1999 |
| WO | 2007045492 | A1 | 4/2007 |

* cited by examiner

SYSTEMS AND METHODS OF AUTO SACKING OF PARCELS

CROSS-REFERENCE TO RELATED APPLICATIONS

This application is a Continuation of U.S. application Ser. No. 16/080,686 having a 371(c) date of Aug. 29, 2018, claiming the benefits of International Application No. PCT/US2017/020417 filed Mar. 2, 2017, as well as of U.S. Provisional Patent Application No. 62/302,537, filed Mar. 2, 2016, each of which is hereby incorporated by reference into the present application as if fully set forth herein.

TECHNICAL FIELD

Aspects of the present invention generally relate to a parcel sack management system and a method.

BACKGROUND OF THE DISCLOSURE

Parcel sack management entails sweeping, tracking, sack filling, identification of the sack and/or contents, closing of the sacks and takeaway of the filled sacks. Currently parcel sack management is done manually by several people at each step of the process.

SUMMARY OF THE DISCLOSURE

Various disclosed embodiments include a parcel sack management system and related process. The parcel sack management system includes a gathering conveyor configured to receive a parcel group at an intake and transport the parcel group to a sack filling station. The system includes a plurality of fill chutes that are transported along a circulating track, each fill chute configured to hold a sack. The parcel sack management system is configured to transfer parcels in the parcel group into a first sack via a first fill chute when the first fill chute is at the sack filling station.

Another embodiment includes a process performed by a parcel sack management system. The process includes receiving a parcel group comprising a plurality of parcels at an intake. The process includes transporting the parcel group on a gathering conveyor to a sacking area. The process includes transporting a first sack on a transportable first fill chute to the sacking area. The process includes transferring the parcels in the parcel group into the first sack via the first fill chute.

In various embodiments, the intake is a buffer configured to collect parcels from a sorter, the buffer having a plurality of buffer discharges. In various embodiments, the intake is plurality of individually controlled buffers, each buffer fitted with a synchronously reciprocating door and paddle belt configuration to provide a controlled output. In various embodiments, after the parcels in the parcel group are transferred into the first sack, the first fill chute is transported along a circulating track to a sack closing station where the first sack is closed. In various embodiments, after the at least some of the parcels in the parcel group are transferred into the first sack, the first fill chute is transported along a circulating track to an intervention station where an operator performs a manual operation to cause any remaining parcels in the parcel group to be transferred into the first sack before the first sack is closed. In various embodiments, after the parcels in the parcel group are transferred into the first sack, the first sack is removed from the first fill chute. In various embodiments, after the first sack is removed from the first fill chute, the first fill chute is transported along a circulating track to an empty stack replenisher, where an empty sack is mounted on first fill chute. In various embodiments, the parcel sack management system associates an identifier with a parcel destination and a first sack. In various embodiments, the parcel sack management system reads an identifier on a first sack and associates the identifier with a parcel destination. In various embodiments, the parcels in each parcel group are tracked, and if an error is detected, the first fill chute with the first sack is transported along a circulating track to an intervention station.

The foregoing has outlined rather broadly the features and technical advantages of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiment disclosed as a basis for modifying or designing other structures for carrying out the same purposes of the present disclosure. Those skilled in the art will also realize that such equivalent constructions do not depart from the spirit and scope of the disclosure in its broadest form.

Before undertaking the DETAILED DESCRIPTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

The figures discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. The numerous innovative teachings of the present application will be described with reference to exemplary non-limiting embodiments.

Current processes for transporting parcels include manual, personnel-intensive processes for placing parcels in sacks and tracking sacks and/or the individual parcels. Such processes are labor intensive and can be prone to error. Disclosed embodiments provide technical solutions for eliminating these issues.

Various disclosed embodiments include a mechanism for automatic high speed sweeping, tracking, sack filling, identification of the sack and/or contents, closing of the sacks, and takeaway of the filled sacks. Disclosed systems and methods automate sack filling with existing sacks taking flow from existing sorters by using a transportable fill chute reservoir to handle sack filling exceptions.

Figure 1:
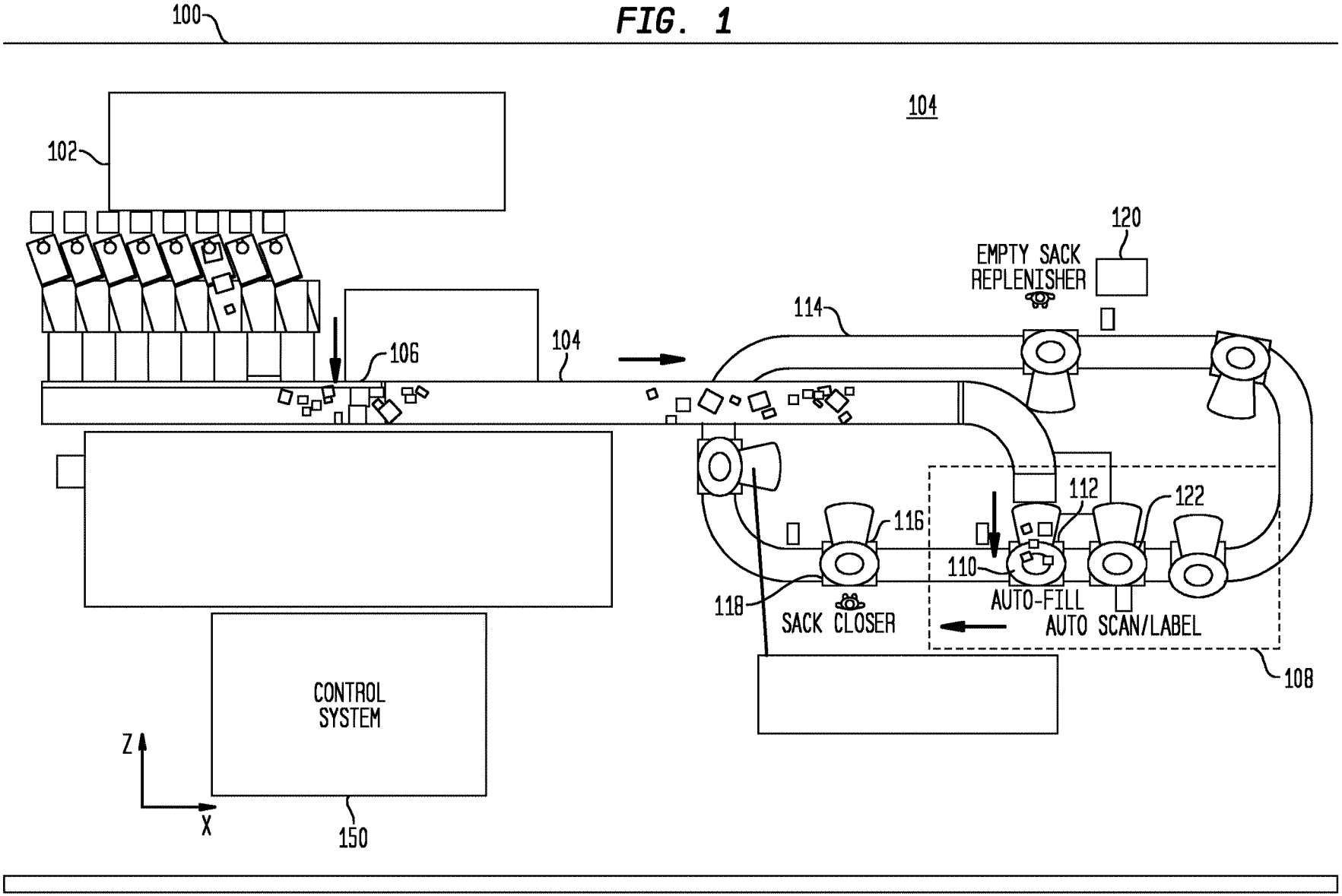
FIG. 1 illustrates an embodiment of a parcel sack management system in accordance with one illustrative embodiment of the present disclosure.

FIG. 1 illustrates an embodiment of a parcel sack management system 100 in accordance with one illustrative embodiment of the present disclosure.

Parcels are received at an intake 102, which can be, for example, a buffer configured to collect parcels from a sorter, the buffer having a plurality of buffer discharges. In this example, intake 102 includes a plurality of individually controlled buffers each with each buffer fitted with a synchronously reciprocating door, belt and paddle belt configuration to provide a controlled output.

The intake 102 transfers a plurality of parcels onto a gathering conveyor 104. When discharged from intake 102, the parcels are typically together in a parcel group 106, such as a group of parcels sorted to a common destination. The sorter can be, for example, a parcel sorter such as a tilt tray sort sorter with a plurality of reciprocating paddle belt outputs.

The parcel group 106 is transported by the gathering conveyor 104 to a sacking area 108 (sack filling station 108). At sacking area 108, the parcels in parcel group 106 are transferred (e.g., dumped) into a transportable fill chute 110 that carries a parcel sack 112 so that they automatically fill parcel sack 112. As described below, the parcel sack 112 is preferably already scanned or labeled to indicate the destination of or other information relating to parcel group 106. The "sack" refers to any sack, tote, or similar container for transporting the parcels.

In some embodiments, the gathering conveyor 104 has a parcel group tracking capability which can sense and report whether parcels remain within the computer-controlled space allocation on the gathering conveyor and, if not, the control system can determine that there is an error with the respective chute or sack, and cause the chute collecting that parcel group to be routed to the intervention station 116 described below.

A plurality of fill chutes 110 are transported along a circulating track 114. Circulating track 114 includes several stations for processing the chutes and parcel sacks. The filled parcel sack 112 is transported by the fill chute 110 to an intervention station 116.

At an optional intervention station 116, any parcels that did not fully enter the sack can be manually placed into the sack, and any other manual operations can be performed by a human operator. For example, contents in the chute that did not fully enter the sack may require manipulation to transfer into the sack before the sack is closed.

The filled parcel sack 112 is transported by the fill chute 110 to a sack closing station 118. In this example, sack closing station 118 is combined with intervention station 116, so no immediate transport is necessary. At sack closing station 118, the filled parcel sack 112 is closed either automatically or manually.

The filled and closed parcel sack 112 can be removed from the fill chute 110 for further processing at sack closing station 118 or at another point along circulating track 114.

The fill chute 110 continues along the circulating track to an empty stack replenisher 120, where an empty sack 112 is mounted on fill chute 110.

The fill chute 110, with empty sack 112, continues along circulating track to scanning-labeling station 122. Scanning-labeling station 122, in some embodiments, places a label on the empty sack 112 that includes a sack identifier associated with the parcel group 106 that will be loaded in that sack at sacking area 108. In other embodiments, scanning-labeling station 112 scans a label already on empty sack 112 to read a sack identifier associated with the parcel group 106 that will be loaded in that sack at sacking area 108.

The fill chutes 110 continue to circulate, filling empty sacks with parcel groups, closing the sacks, having the filled sacks removed, and being replenished with empty sacks.

Control system 150 controls the operation of parcel sack management system 100. Control system 150 maintains the association between the sack identifiers and the respective parcel groups 106 that fill each sack.

Note that various "stations" and areas can be combined or separated in different embodiments. For example, the sacking area can also be the same physical area as the sack closing station, in some embodiments.

Figure 2:
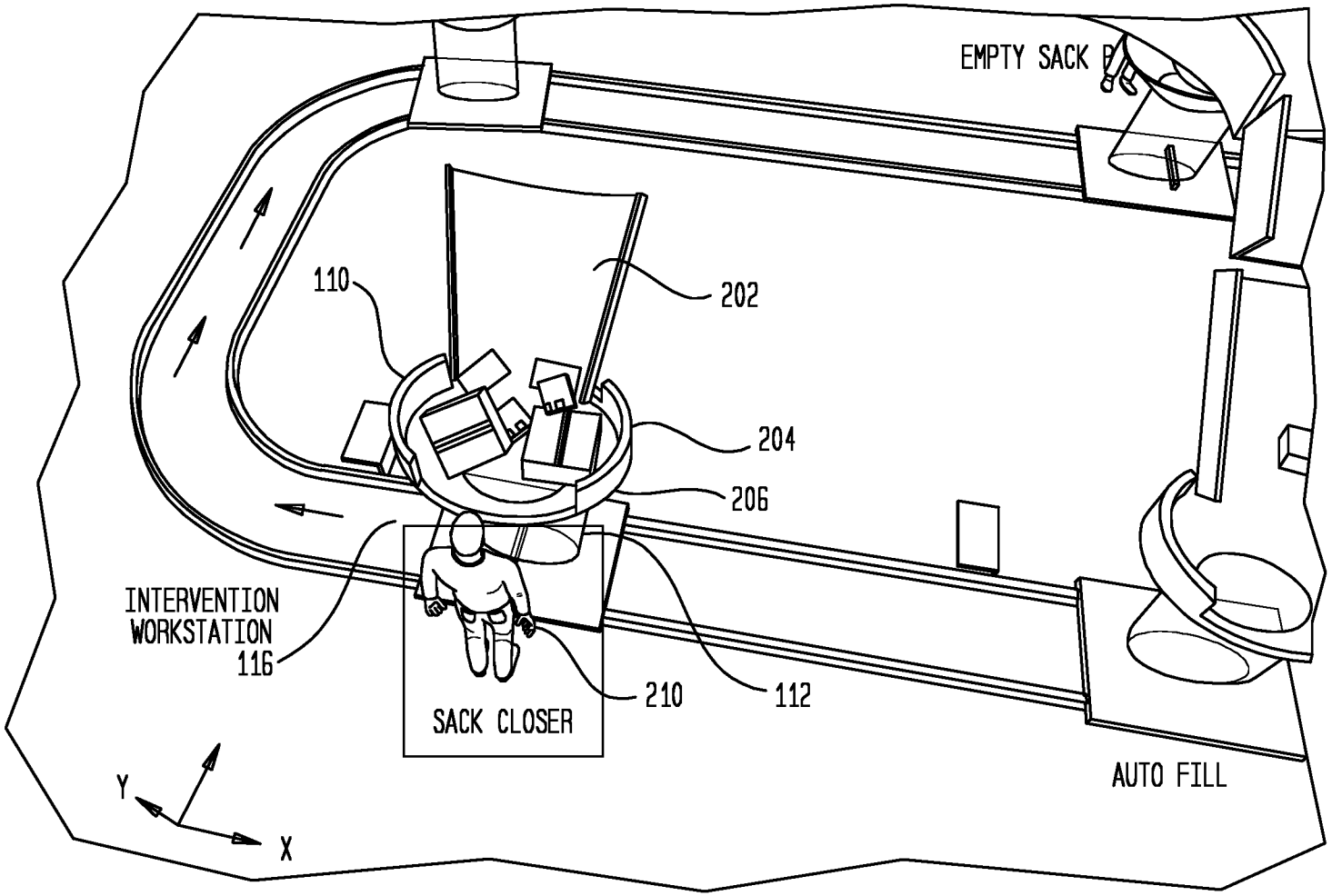
FIG. 2 illustrates a more detailed view of an embodiment of a transportable fill chute at an intervention station in accordance with one illustrative embodiment of the present invention.

FIG. 2 illustrates a more detailed view of an embodiment of a transportable fill chute 110 at an intervention station 116 in accordance with one illustrative embodiment of the present invention.

Fill chute 110 includes a chute structure 202 that is configured to receive the parcels from the gathering conveyor 104. Fill chute 110 includes a containment rim 204 that retains any packages that did not completely pass down chute structure 202 into sack 112 that is mounted on and beneath fill chute 110 on a sack holder 206. At intervention station 116, an operator 210 can manually clear any jams and ensure that all parcels are properly placed into sack 112.

Figure 3:
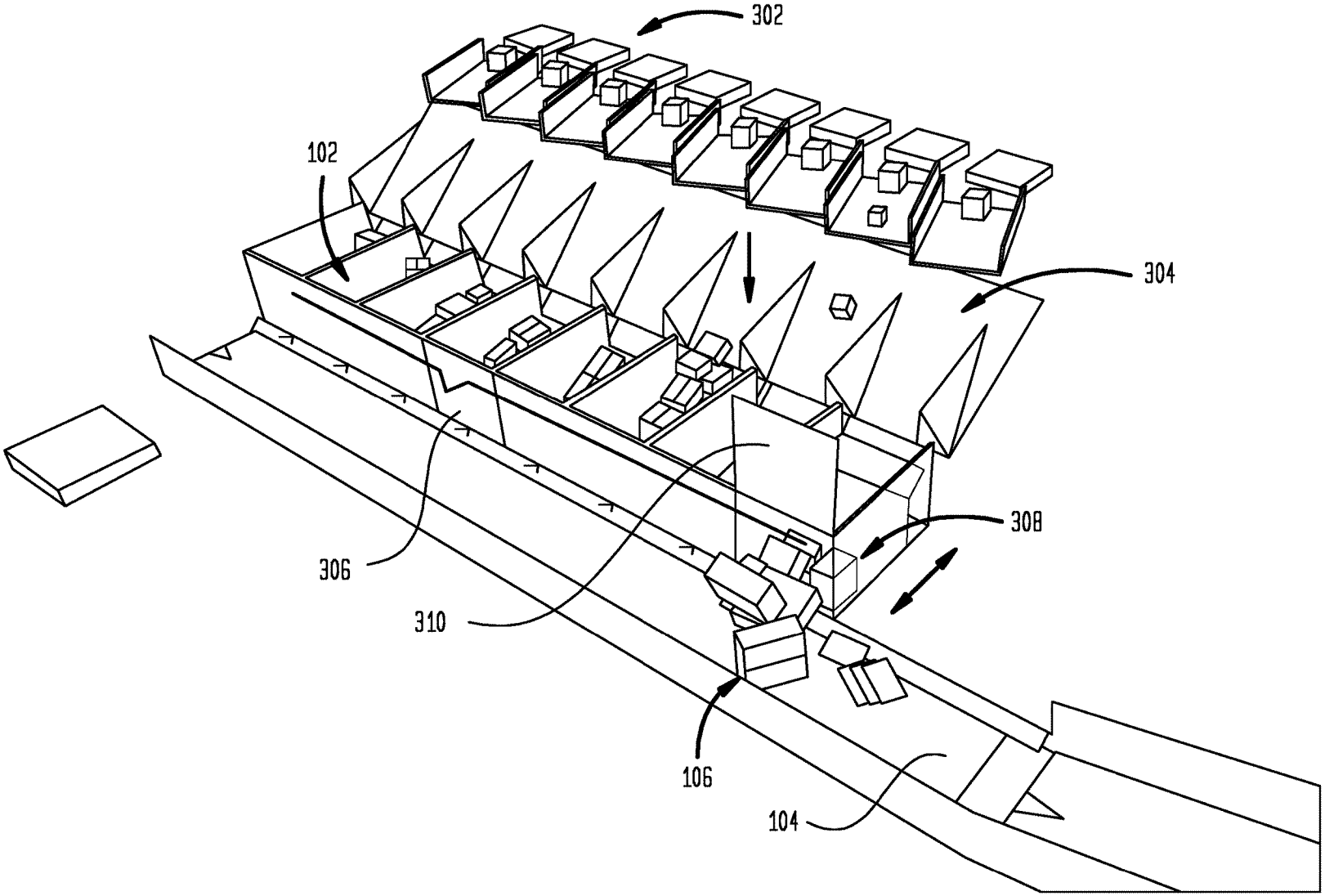
FIG. 3 illustrates an embodiment of an intake in accordance with one illustrative embodiment of the present disclosure.

FIG. 3 illustrates an embodiment of an intake 102 in accordance with one illustrative embodiment of the present disclosure. In this example, intake 102 is a sorter 302 with a tilt tray 304 at each output, controlled buffers 306 at each output, and a reciprocating paddle belt 308 at each output. Closable doors 310 at each output control when each parcel group 106, at each output, are released onto gathering conveyor 104. As each door 310 is opened to output a parcel group, the paddle belt 308 pushes the parcels onto the gathering conveyor 104.

Figure 4:
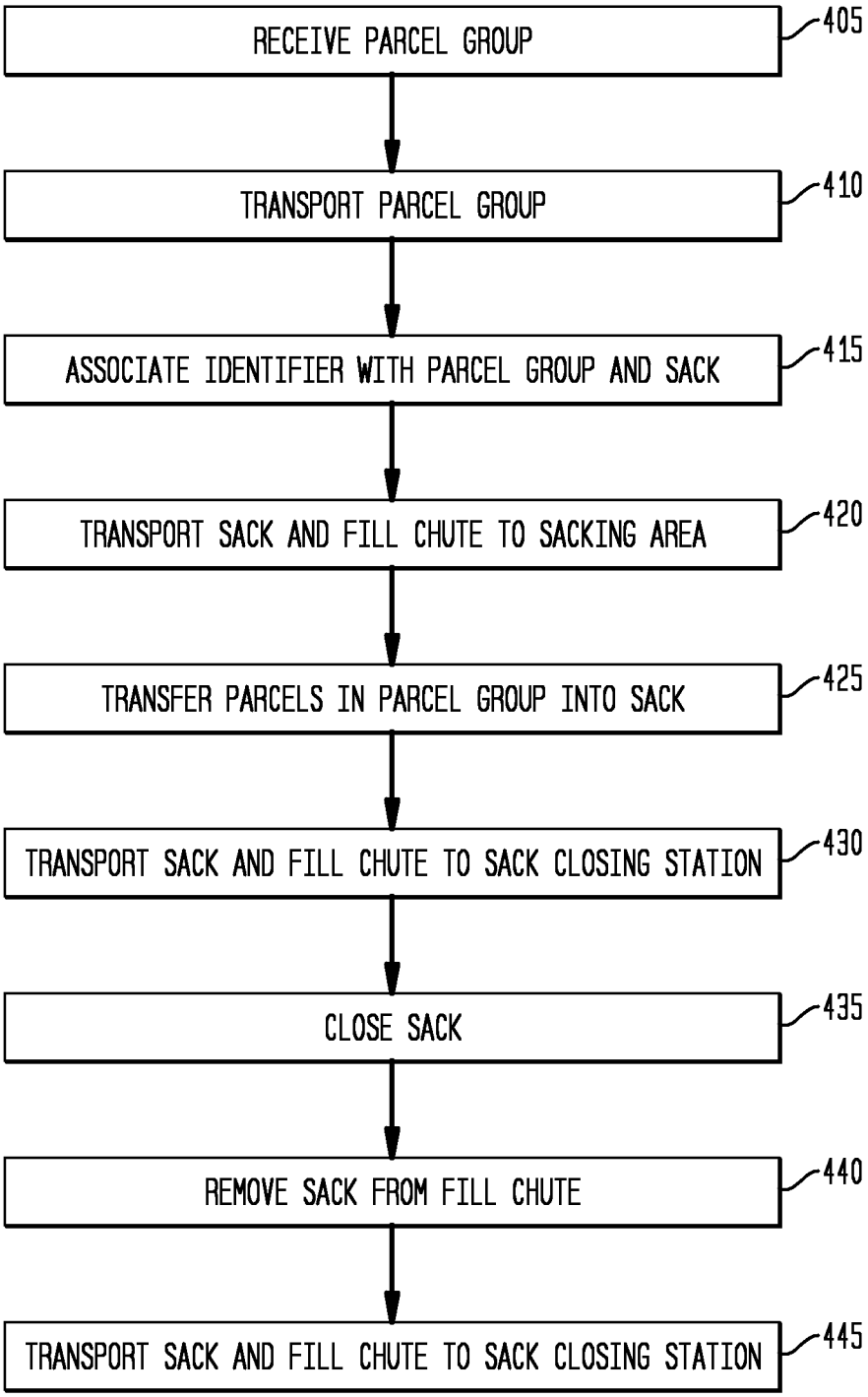
FIG. 4 is a flowchart of a process in accordance with disclosed embodiments that can be performed by a parcel sack management system as disclosed herein.

FIG. 4 is a flowchart of a process in accordance with disclosed embodiments that can be performed by a parcel sack management system as disclosed herein, referred to generically as the "system." Note that while the example below describes the operations with regard to a single parcel group, the system in operation will process multiple parcel groups in succession.

The system receives a plurality of parcels ("parcel group") at an intake (405). As described herein, the intake can be a buffer or parcel sorter and the parcel group can be a group of parcels sorted to a common destination.

The system transports the parcel group on a gathering conveyor to a sacking area (410).

The system associates an identifier with a parcel destination and a sack (415). As described herein, this can be accomplished by reading an identifier on the sack or by labeling the sack with the identifier. The control system can store the identifiers and associations.

The system transports the sack on a transportable fill chute to the sacking area (420).

In the sacking area, the system transfers the parcels in the parcel group into the sack via the transportable fill chute (425), such as by dumping the parcels in the parcel group from the gathering conveyor into the fill chute.

The system transports the fill chute with the filled sack along a circulating track to a sack closing station (430).

The sack is closed at the sack closing station (435). The sack can be closed manually by an operator or is closed automatically by the system.

The sack is removed from the fill chute (440).

The system transports the fill chute along the circulating track to an empty stack replenisher, where an empty sack is mounted on fill chute (445).

The identifier can thereafter be used for processing the filled sack according to, for example, the destination associated with the identifier.

During the process of FIG. 4, the system can also track the parcels in the parcel group to ensure that all parcels in the parcel group are transferred into the sack. The system can track whether any of the parcels in that parcel group remain in a computer-controlled space on the gathering conveyor that is allocated to that parcel group. If the system detects an error, for example if parcels remain in the allocated space on the gathering conveyor after the parcels should have been transferred to the sack, the system can take an action such as moving the chute and sack to the intervention station.

Figure 5:
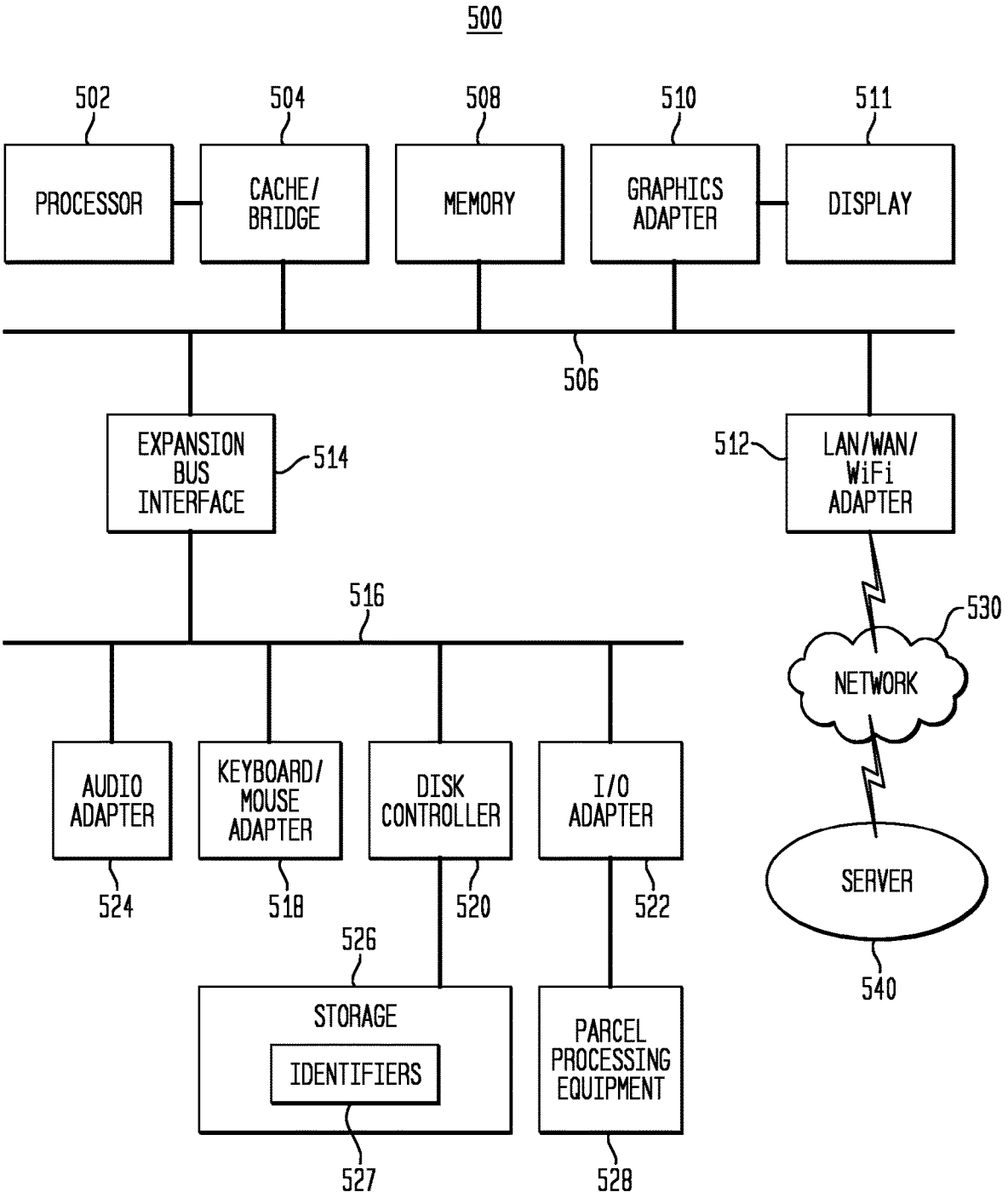
FIG. 5 illustrates a block diagram of a data processing system with which an embodiment can be implemented.

FIG. 5 illustrates a block diagram of a data processing system with which an embodiment can be implemented, for example as control system 150 or other device configured by software or otherwise to perform the processes as described herein, and in particular as each one of a plurality of interconnected and communicating systems as described herein. The data processing system depicted includes a processor 502 connected to a level two cache/bridge 504, which is connected in turn to a local system bus 506. Local system bus 506 may be, for example, a peripheral component interconnect (PCI) architecture bus. Also connected to local system bus in the depicted example are a main memory 508 and a graphics adapter 510. The graphics adapter 510 may be connected to display 511.

Other peripherals, such as local area network (LAN)/Wide Area Network/Wireless (e.g. WiFi) adapter 512, may also be connected to local system bus 506. Expansion bus interface 514 connects local system bus 506 to input/output (I/O) bus 516. I/O bus 516 is connected to keyboard/mouse adapter 518, disk controller 520, and I/O adapter 522. Disk controller 520 can be connected to a storage 526, which can be any suitable machine usable or machine readable storage medium, including but not limited to nonvolatile, hard-coded type mediums such as read only memories (ROMs) or erasable, electrically programmable read only memories (EEPROMs), magnetic tape storage, and user-recordable type mediums such as floppy disks, hard disk drives and compact disk read only memories (CD-ROMs) or digital versatile disks (DVDs), and other known optical, electrical, or magnetic storage devices. Storage 526 can store any data or executable instructions useful in performing processes as described herein, including in particular the identifiers 527 discussed above.

I/O adapter 522 is connected to control parcel processing equipment 528, which can be any of the elements illustrated in FIGS. 1-3.

Also connected to I/O bus 516 in the example shown is audio adapter 524, to which speakers (not shown) may be connected for playing sounds. Keyboard/mouse adapter 518 provides a connection for a pointing device (not shown), such as a mouse, trackball, trackpointer, touchscreen, etc.

Those of ordinary skill in the art will appreciate that the hardware depicted in FIG. 5 may vary for particular implementations. For example, other peripheral devices, such as an optical disk drive and the like, also may be used in addition or in place of the hardware depicted. The depicted example is provided for the purpose of explanation only and is not meant to imply architectural limitations with respect to the present disclosure.

A data processing system in accordance with an embodiment of the present disclosure includes an operating system employing a graphical user interface. The operating system permits multiple display windows to be presented in the graphical user interface simultaneously, with each display window providing an interface to a different application or to a different instance of the same application. A cursor in the graphical user interface may be manipulated by a user through the pointing device. The position of the cursor may be changed and/or an event, such as clicking a mouse button, generated to actuate a desired response.

One of various commercial operating systems, such as a version of Microsoft Windows™ a product of Microsoft Corporation located in Redmond, Wash. may be employed if suitably modified. The operating system is modified or created in accordance with the present disclosure as described.

LAN/WAN/Wireless adapter 512 can be connected to a network 530 (not a part of data processing system 500), which can be any public or private data processing system network or combination of networks, as known to those of skill in the art, including the Internet. Data processing system 500 can communicate over network 530 with server system 540, which is also not part of data processing system 500, but can be implemented, for example, as a separate data processing system 500.

Disclosed embodiments solve a number of technical problems in parcel processing. One problem solved is that of auto sweep, or the controlled removal of sorted parcels away from a tilt tray sorter or other sorter types, using controlled discharge and spacing of pre-identified parcel like item groups from one in a series of discrete buffers using a reciprocating paddle conveyor and closeable through gate. Released parcels flow through the closeable gate onto a common gathering conveyor in associated parcel groupings. Release of parcel groupings are computer-timed such that associated parcel groups are separated by vacancy or open space before and after each grouping thus accomplishing and keeping separation on the gathering conveyor. Separate and identified groupings are individually tracked by computer as they transport to the end of the conveyor.

Another solved is that of auto containerization, or auto-sacking with less or no manual assist, by tracking discrete parcel group pre-identified by computer tracking then associating the parcel group ID with a pre-scanned ID on discrete and moveable fill chutes with integrated sack holder. When parcel groups transfer to the fill chutes from the gathering conveyor the computer associates/records the parcel group ID with the discrete ID scanned on a transportable fill chute. The sack holder prior to receiving parcels has a sack automatically or manually placed and temporarily locked onto the funnel like device. If a bar code or human readable label or electronic ID such as RFID is required on the sack it too can be generated and associated with the parcel group and/or fill chute ID and optionally automatically transmitted, registered and/or placed in or on the sack or ID devices within.

Another problem solved is that is there are times when a parcel can be of such size or form relative to the sack opening it can clog or jam entry requiring manual intervention. The desired rate of automatic filling makes manual intervention at the fill point unsafe and impossible. Changing to a larger size sack is impractical when millions of current size sacks are in circulation. Disclosed embodiments provide a novel solution to this problem is by creating and using equivalent sack volume space in the transportable fill chute. The transportable fill chute can receive, contain, and allow transport of the percentage of parcels unable to enter the sack held by the integrated sack holder. The transportable fill chute with integrated sack holder and held sack can move away from automatic filling station to a place where intervention will not be unsafe or encumber the next fill chute from indexing to accept the next parcel group to be discharged from the gathering conveyor.

Those skilled in the art will recognize that, for simplicity and clarity, the full structure and operation of all systems suitable for use with the present disclosure is not being depicted or described herein. Instead, only so much of the physical systems as is unique to the present disclosure or necessary for an understanding of the present disclosure is depicted and described. The remainder of the construction and operation of the systems disclosed herein may conform to any of the various current implementations and practices known in the art.

It is important to note that while the disclosure includes a description in the context of a fully functional system, those skilled in the art will appreciate that at least portions of the mechanism of the present disclosure are capable of being distributed in the form of a instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs). In particular, computer readable mediums can include transitory and non-transitory mediums, unless otherwise limited in the claims appended hereto.

Although an exemplary embodiment of the present disclosure has been described in detail, those skilled in the art will understand that various changes, substitutions, variations, and improvements disclosed herein may be made without departing from the spirit and scope of the disclosure in its broadest form. In particular, the features and operations of various examples described herein and in the incorporated applications can be combined in any number of implementations.

None of the description in the present application should be read as implying that any particular element, step, or function is an essential element which must be included in the claim scope: the scope of patented subject matter is defined only by the allowed claims. Moreover, none of these claims are intended to invoke 35 USC § 112(f) unless the exact words "means for" are followed by a participle.

What is claimed is:

1. An intake for handling sorted parcels, the intake comprising:

a sorter, and a plurality of individually controlled buffers, each buffer configured to collect sorted parcels from the sorter and to provide a controlled output of a parcel group;

wherein each buffer comprises a closable door, a belt and an interior paddle.

2. The intake of claim 1, wherein the sorter comprises one or more chutes, wherein a chute of the sorter is aligned with a buffer such that parcels slide into the individually controlled buffers via the chute.

3. The intake of claim 2, wherein the parcels are sorted to parcel groups of a common destination into each buffer.

4. The intake of claim 1, wherein the interior paddle is coupled to the belt so that the paddle moves with the belt.

5. The intake of claim 1, wherein the closable door, the belt and the paddle are configured as a synchronously reciprocating door, belt and paddle configuration to provide the controlled output.

6. The intake of claim 5, wherein, when the closable door is open, the paddle and belt push the parcel groups onto a gathering conveyor.

7. A parcel management system comprising:

an intake comprising:

a sorter, and a plurality of individually controlled buffers, each buffer configured to collect sorted parcels from the sorter and to provide a controlled output of a parcel group, and a gathering conveyor, wherein the parcel groups are released onto the gathering conveyor in a timed manner, such that the parcel groups are separated by vacancy or open space before and after each parcel group;

wherein each buffer comprises a closable door, a belt and an interior paddle.

8. The parcel management system of claim 7, wherein the sorter comprises one or more chutes, wherein a chute of the sorter is aligned with a buffer such that parcels slide into the individually controlled buffers via the chute.

9. The parcel management system of claim 7, wherein the closable door, belt and paddle are configured as a synchronously reciprocating door, belt and paddle configuration to provide the controlled output.

10. The parcel management system of claim 9, wherein, when the closable door is open, the belt and paddle push the parcel groups onto the gathering conveyor.

11. A method for handling sorted parcels comprising:

collecting parcels from a sorter and providing controlled outputs of sorted parcel groups by a plurality of individually controlled buffers onto a gathering conveyor, wherein each buffer comprises a synchronously reciprocating door, belt and paddle configuration to provide the controlled output of the sorted parcel groups.

12. The method of claim 11, further comprising:

releasing the sorted parcel groups onto the gathering conveyor in a timed manner, such that the sorted parcel groups are separated by vacancy or open space before and after each parcel group.

13. The method of claim 12, further comprising:

pushing, by the belt and paddle, the parcel groups onto the gathering conveyor when the closable door is open.

* * * * *